US011668488B2

(12) United States Patent
Revilla et al.

(10) Patent No.: US 11,668,488 B2
(45) Date of Patent: Jun. 6, 2023

(54) SYSTEM AND METHOD OF CONTROLLING A HEAT TRANSFER SYSTEM

(71) Applicant: Rheem Manufacturing Company, Atlanta, GA (US)

(72) Inventors: Jorge Miguel Gamboa Revilla, Oxnard, CA (US); Satya Kiran Gullapalli, Camarillo, CA (US); Sergio Fernando Montalgo Salazar, Calexico, CA (US); Juan Carlos Montanez, Oxnard, CA (US); Amin Monfared, Oxnard, CA (US); Alexander Chow, Camarillo, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 368 days.

(21) Appl. No.: 17/017,945

(22) Filed: Sep. 11, 2020

(65) Prior Publication Data

US 2022/0082288 A1 Mar. 17, 2022

(51) Int. Cl.
*F24H 15/175* (2022.01)
*F24H 15/215* (2022.01)
(Continued)

(52) U.S. Cl.
CPC ..... *F24F 11/80* (2018.01); *F24H 15/175* (2022.01); *F24H 15/215* (2022.01); *F24H 15/219* (2022.01); *F24H 15/395* (2022.01)

(58) Field of Classification Search
CPC ..... F24D 19/1012; F24D 19/0092; F24D 19/10–1096; F24H 15/104; F24H 15/175;
(Continued)

(56) References Cited

U.S. PATENT DOCUMENTS 2,828,723 A * 4/1958 Miller ..... F24H 1/145 165/177
5,322,216 A 6/1994 Wolter et al.
(Continued)

FOREIGN PATENT DOCUMENTS

EP 2492602 A1 * 8/2012 ..... F24H 1/22

OTHER PUBLICATIONS

Installation and Operating Manual for "Hybrid Gas Water Heaters," State Water Heaters, Nov. 1, 2010, available at https://www.statewaterheaters.com/lit/im/res-gas/319867-000.pdf, 60 pages.

*Primary Examiner* — Edelmira Bosques
*Assistant Examiner* — Michael James Giordano
(74) *Attorney, Agent, or Firm* — Eversheds Sutherland (US) LLP

(57) ABSTRACT

System and methods for controlling operating state of a heat transfer system are disclosed herein. The heat transfer system can include temperature sensor positioned at the fluid inlet line and the fluid outlet line and a heat exchanger between the fluid inlet line and the fluid outlet line. The heat transfer system can include a processor communicatively coupled to the first temperature sensor and the second temperature sensor. The processor can determine an inlet temperature of water flowing in the fluid inlet line and outlet temperature of water flowing in the fluid outlet line and can determine a delta temperature based on difference between the inlet temperature and the outlet temperature. Based on the inlet temperature and the delta temperature, the processor can determine an operating state of the heat transfer system.

15 Claims, 4 Drawing Sheets

(51) Int. Cl.
*F24H 15/219* (2022.01)
*F24H 15/395* (2022.01)
*F24F 11/80* (2018.01)

(58) Field of Classification Search
CPC ..... F24H 15/288; F24H 9/0036; F24H 9/40–455
See application file for complete search history.

(56) References Cited

U.S. PATENT DOCUMENTS

| | | | |
|---|---|---|---|
| 8,762,106 | B2 | 6/2014 | Miller |
| 10,544,722 | B2 | 1/2020 | Pradun et al. |

* cited by examiner

SYSTEM AND METHOD OF CONTROLLING A HEAT TRANSFER SYSTEM

FIELD

The present disclosure relates to heat transfer systems. More specifically, the present disclosure relates to systems and methods for monitoring and controlling the operating state of heat transfer systems.

BACKGROUND

Heat transfer systems are widely used in various applications, including but not limited to, environmental heating and cooling, and water heaters for industrial, commercial, and residential applications. Design of the heat transfer systems, such as the ones used in water heaters (e.g., in a pool water heater) impose various challenges associated with heating of water. Typical deigns of the water heaters include a heat exchanger through which cold water, entering the water heater, is circulated to absorb heat. The hot water generated by the heat exchanger exits the water heater via plumbing fixtures and is made available for various requirements. The design of a particular heat transfer system can imposes various challenges related to the functioning and performance of the heat transfer system.

Water entering the heat transfer system may be cooled relative a dew point of air and/or any exhaust gases circulating in the water heater, making it possible to condense water vapor from the air and/or the exhaust gases. In many cases, the condensation accumulate within the water heater. For example, the condensation can accumulate on the heat exchanger and other parts or components of the water heater, which can reduce the efficiency of the water heater and/or cause the water heater to shut off completely.

Further, the water supply can have high levels of dissolved solids in the form of mineral content, such as calcium and magnesium. Heating the water can cause the dissolved solids to precipitate from the water. The dissolved solids can precipitate on the conduits of the heat exchanger, the water inlet/outlet lines, and other hot surfaces of the water heater forming scales, for example. The resulting scaling can result in reduced efficiency of the water heater and may even lead to failure of the water heater.

Thus, condensation and scaling can occur in water heaters and other related heat transfer systems, which can significantly impact the performance of such systems. Manual efforts to control the condensation and scaling can be challenging or may not be feasible in every situation. Also, manually controlling the heaters can be prone to human errors leading to degradation of the heating systems. Thus, there exists a need to improve the process of controlling the heaters.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

The present disclosure includes a heat transfer system. The heat transfer system can include a fluid inlet line and a fluid outlet line. The fluid inlet line can include a first temperature sensor and the fluid outlet line can include a second temperature sensor. The heat transfer system can include a heat exchanger disposed between the fluid inlet line and the fluid outlet line. The heat transfer system can include a processor that determines an inlet temperature from data received from the first temperature sensor and determines an outlet temperature from data received from the second temperature sensor. The processor can determine a delta temperature based on the difference between the inlet temperature and the outlet temperature. The processor can determine or select an operating state of the heat transfer system based on the inlet temperature and the delta temperature.

The present disclosure includes a method of controlling a heat transfer system. The method can include obtaining, by a processor, operating parameters for a heat exchanger. The method can include, processing, by the processor, the operating parameters to determine operating states for the heat exchanger. In addition, the method can include obtaining, by the processor, an inlet temperature ($T_{inlet}$) corresponding to a fluid inlet line. The method can include obtaining, by the processor, an outlet temperature ($T_{outlet}$) corresponding to a fluid outlet line. The method can include determining, by the processor, a delta temperature ($\Delta T$) based on the difference between the inlet temperature and the outlet temperature. The method can include determining or selecting, by the processor, an operating state of a heat exchanger among the operating states based on the inlet temperature and the delta temperature.

The present disclosure includes a non-transitory computer-readable medium having instructions stored thereon. The instructions as discussed herein, when executed by a processor, can cause the performance of operations to determine an inlet temperature and an outlet temperature corresponding to a fluid inlet line and a fluid outlet line, respectively. The processor can perform operations to determine a delta temperature based on the difference between the inlet temperature and the outlet temperature. The processor can perform operations to determine or select an operating state of a heat exchanger based on the inlet temperature and the delta temperature.

These and other aspects, features, embodiments, implementations, and advantages of the present disclosure may be appreciated from a review of the following detailed description of the present disclosure, along with the accompanying figures in which like reference numerals refer to like parts throughout.

BRIEF DESCRIPTION OF THE DRAWINGS

A better understanding of embodiments of the present disclosure (including alternatives and/or variations thereof) may be obtained with reference to the detailed description of embodiments along with the following drawings, in which.

DETAILED DESCRIPTION

Prior to discussing specific embodiments of the present solution, it may be helpful to describe aspects of an operating environment as well as associated system components (e.g., hardware elements) in connection with the methods and systems described herein.

Figure 1:
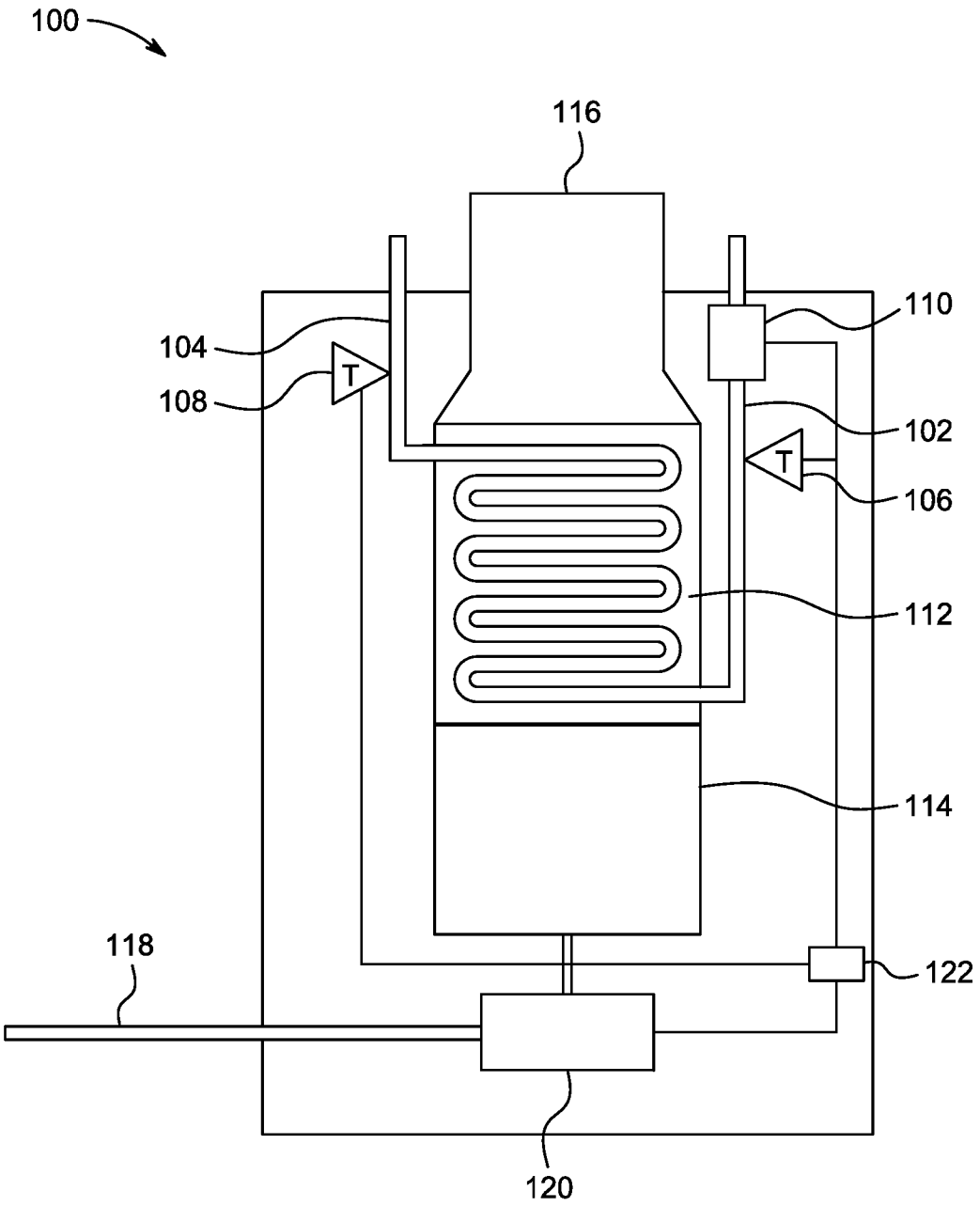
FIG. 1 is a schematic diagram of a heat transfer system, in accordance with the disclosure.

FIG. 1 is a block diagram of a heat transfer system, exemplified using a water heater 100, in accordance with the present disclosure. The water heater 100 can include a water inlet line 102, a water outlet line 104, an inlet water temperature sensor 106, an outlet water temperature sensor 108, a water flow control valve 110, a heat exchanger 112, a burner 114, an exhaust port 116, a fuel supply line 118, a fuel supply control valve 120, and a control system 122.

The water inlet line 102 can be connected to a water source to receive cold or unheated water. The water source can include, but is not limited to, a swimming pool, a water storage tank, and a municipal water supply. The inlet water temperature sensor 106 can detect and/or measure temperature of water entering the water heater 100 via the water inlet line 102. The inlet water temperature sensor 106 can be positioned anywhere on the water inlet line 102.

The heat exchanger 112 can be operably coupled between the water inlet line 102 and the water outlet line 104. The heat exchanger 112 can be configured to transfer a sufficient amount of heat to water flowing through the water heater so that the water attains a desired temperature. The heat exchanger 112 can include an inlet port that receives water from the water inlet line 102. The inlet port of the heat exchanger 112 can open into an inlet manifold that distributes water entering the inlet port of the heat exchanger 112 to a plurality of fluid flow paths. The plurality of fluid flow paths can include, but are not limited to, tubes, plates, plate-fins, and microchannels. The opposite end of each of the plurality of fluid flow paths can be connected to an output manifold that couples to an outlet port of the heat exchanger 112. The outlet port of the heat exchanger 112 can be coupled to the water outlet line 104.

The water heater 100 can include a heating element, such as the burner 114. The burner 114 can be configured to burn a combustible fuel. The burner 114 can be positioned proximately below the heat exchanger 112 and can be operably coupled to the fuel supply control valve 120. The fuel control valve 120 can be configured to control the flow of the combustible fuel from the fuel supply line 118 to the burner 114. The fuel supply line 118 can be operably coupled to a fuel source. The combustible fuel can include, but is not limited to, propane, butane, and methane. The burner 114 can generate heat and exhaust gas (or hot exhaust gas) by burning the combustible fuel. The hot exhaust gas generated by the burner 114 can travel upward through the heat exchanger 112 and exit the water heater 100 through the exhaust port 116.

The heat and the hot exhaust gas generated by the burner 114 can flow over the plurality of fluid flow paths of the heater exchanger 112, transferring heat from the exhaust gas to the water flowing through the plurality of fluid flow paths. The plurality of fluid flow paths can be formed from one or more materials having a high heat transfer coefficient. The materials used for the plurality of fluid flow paths can include, but are not limited to, copper, titanium, aluminum, and stainless steel. The plurality of fluid flow paths of the heat exchanger 112 can provide a circuitous path to increase available area for receiving heat from the hot exhaust gas, thereby increasing the amount of heat transfer to the water. The circuitous path of the plurality of fluid flow paths through heat exchanger 112 can establish a sufficient surface area for heat transfer between the flowing hot exhaust gas and the water flowing in the plurality of fluid flow paths. The heat exchanger 112 can heat the water to a desired temperature as the water flows through the heat exchanger 112.

The water outlet line 104 can be connected to plumbing fixtures to supply hot water for various needs. The plumbing fixtures can include, but are not limited to showers, tubs, sinks, taps, and swimming pools. The outlet water temperature sensor 108 can measure temperature of water exiting the water heater 100 via the water outlet line 104. The outlet water temperature sensor 108 can be positioned anywhere on the water outlet line 104. The inlet water temperature sensor 106 and the outlet water temperature sensor 108 can include, but are not limited to, thermocouple sensors, Resistor Temperature Detector (RTD) sensors, thermistor temperature sensors, semiconductor-based temperature sensors, and infrared temperature sensors. The water flow control valve 110 can control the rate of flow of water in the water inlet line 102. Controlling the rate of flow of water in the water inlet line 102 can also controls the rate of flow of water entering the heat exchanger 112.

The water heater 100 can include the control system 122 that controls the overall operation of the water heater 100. The control system 122 can be designed to monitor the operations of water heater 100 and control the operations to ensure safety and longevity of the water heater 100. The control system 122 can receive one or more inputs including operating parameters of the water heater 100. For example, the control system 122 can receive operating parameters of the water heater 100 from a user (e.g., via a connected input/output device, from a computing device of the user). Alternatively or additionally, the control system 122 can be hardwired and/or preprogrammed with operating parameters of the water heater 100 (e.g., as a factory default). The operating parameters can include, but are not limited to, a temperature set-point which corresponds to a temperature of water that has been set for the water heater 100 to maintain, water flow rate which corresponds to the rate of flow of water in the water inlet line 102 and/or the heat exchanger 112, inlet (or cold) water temperature which corresponds to the temperature of water flowing in the water inlet line 102, outlet (or hot) water temperature which corresponds to the temperature of water flowing in the water outlet line 104, minimum and maximum allowed temperatures for water entering the water heater 100, operating efficiency of the water heater 100, and heating capacity of the water heater 100. Based at least in part on the operating parameters, the control system 122 can determine operating states of the water heater 100, as disclosed herein.

The control system can be coupled to the inlet water temperature sensor 106, the outlet water temperature sensor 108, the water flow control valve 110, and the fuel supply control valve 120. The control system 122 can obtain temperature input from the inlet water temperature sensor 106, and the outlet water temperature sensor 108. Using the temperatures from inlet water temperature sensor 106, and the outlet water temperature sensor 108, the control system 122 can determine a delta temperature, which is a difference of a temperature obtained between the outlet water temperature sensor 108 and the temperature obtained from the inlet water temperature sensor 106. Based at least in part on the delta temperature and the inlet water temperature sensor 106, the control system 122 can determine or select an operating state among the operating states of the water heater 100. Depending on the selected operating state of the water heater 100, the control system 122 can control the water flow control valve 110 to increase, decrease or maintain the flow of water to drive the water heater 100 to a desired operating state or target operating state. The control system 122 is described in more detail in FIG. 2.

Although the water heater 100 shown in FIG. 1 does not include a storage tank, the disclosed water heater 100 can optionally include a storage tank such as to store water heated by the water heater 100. Also, the heating element of the water heater 100 can additionally or alternately include other forms of the heating element, such as electric heating elements. For example, while the water heater 100 discussed above with reference to FIG. 1 is described as a fuel-fired water heater, the water heater 100 can instead be an electric water heater having a storage tank and electric resistance heating element, a wood-fired water heater, or the like.

Figure 2:
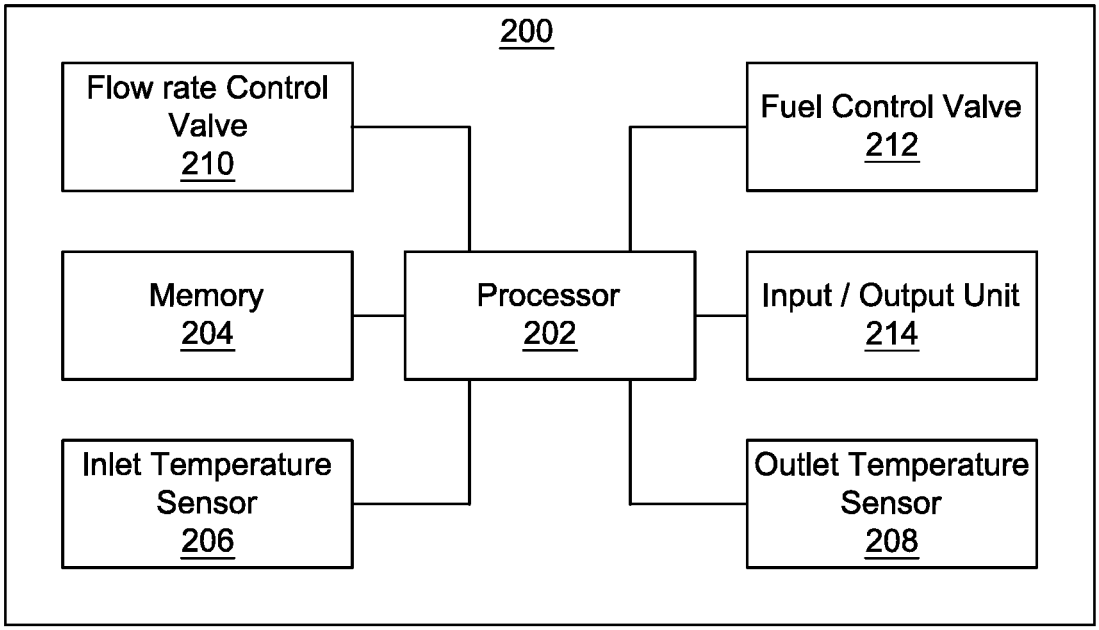
FIG. 2 is a block diagram of a control system for use with the heat transfer system, in accordance with the disclosure.

FIG. 2 is a block diagram of a control system for use with the water heater 100 and configured to control the operating state of the water heater 100, in accordance with the present disclosure. With reference to FIG. 2, there is shown a control system 200. The control system 200 can correspond to the control system 122 of FIG. 1. The control system 200 can include one or more processors, such as a processor 202, a memory 204, an inlet temperature sensor 206, an outlet temperature sensor 208, a flow rate control valve 210, a fuel control valve 212, and an input/output unit 214. FIG. 2 is described in conjunction with elements of FIG. 1 and various elements of FIG. 2 may correspond to elements described in FIG. 1. For example, the control system 200, the inlet temperature sensor 206, the outlet temperature sensor 208, the flow rate control valve 210, and the fuel control valve 212 of FIG. 2 can correspond to the control system 122, the inlet water temperature sensor 106, the outlet water temperature sensor 108, the water flow control valve 110, and the fuel supply control valve 120 of FIG. 1, respectively.

The processor 202 can be communicatively coupled to the memory 204, the inlet temperature sensor 206, the outlet temperature sensor 208, the flow rate control valve 210, the fuel control valve 212, and/or the input/output unit 214.

The processor 202 can comprise suitable logic, circuitry, interfaces, and/or code that can be configured to execute a set of instructions stored in the memory 204. The processor 202, in conjunction with the inlet temperature sensor 206, the outlet temperature sensor 208, the flow rate control valve 210, and the fuel control valve 212 can be configured to monitor and control the operating state of the water heater 100. The processor 202 can be implemented based on a number of processor technologies known in the art. Examples of the processor 202 are an X86-based processor, a Reduced Instruction Set Computing (RISC) processor, an Application-Specific Integrated Circuit (ASIC) processor, a Complex Instruction Set Computing (CISC) processor, and/or other processor.

The memory 204 can comprise suitable logic, circuitry, interfaces, and/or code that can be configured to store the set of instructions, which may be executed by the processor 202. The memory 204 can be further configured to store algorithm(s) to determine temperature range(s) corresponding to one or more operating states of the water heater 100 and to store one or more system parameters associated with the water heater 100. The memory 204 can be further configured to store the temperature range(s) corresponding to the one or more operating states of the water heater 100. The memory 204 can be implemented based on a Random Access Memory (RAM), a Read-Only Memory (ROM), a Hard Disk Drive (HDD), a storage server, and/or a Secure Digital (SD) card.

The inlet temperature sensor 206 can comprise suitable hardware, logic, circuitry, interfaces, and/or code configured to measure the temperature of water entering the water heater 100 via the water inlet line 102. The inlet temperature sensor 206 can be implemented using thermocouple sensors, Resistor Temperature Detector (RTD) sensors, thermistor temperature sensors, semiconductor-based temperature sensors, and/or infrared temperature sensors.

Likewise, the outlet temperature sensor 208 can comprise suitable hardware, logic, circuitry, interfaces, and/or code configured to measure the temperature of water exiting the water heater 100 via the water outlet line 104. The outlet temperature sensor 208 can be implemented using thermocouple sensors, Resistor Temperature Detector (RTD) sensors, thermistor temperature sensors, semiconductor-based temperature sensors, and/or infrared temperature sensors. The inlet temperature sensor 206 and the outlet temperature sensor 208 can be of similar make, which can help facilitate simple and easy compatibility within the heater system 100 and can help to reduce errors associated with temperature measurements.

The flow rate control valve 210 can comprise suitable hardware, logic, circuitry, mechanical design and structure, interfaces, and/or code configured to detect, measure, and/or determine the rate of flow of water in the water inlet line 102 (e.g., via a flow rate sensor). The flow rate control valve 210 can be configured to control the rate of flow of water in the water inlet line 102 and thus, controlling the rate of flow of water entering the heat exchanger 112. The flow rate control valve 210 can include, but is not limited to, one or more of any of: solenoid valves, gate valves, globe valves, pinch valves, diaphragm valves, needle valves, butterfly valves, plug valves, and ball valves.

In The flow rate control valve 210 can be configured to detect or measure the rate of flow of water in the water inlet line 102 and can be configured to control the flow of water in the water inlet line 102 based on signals received from the processor 202.

The fuel control valve 212 can comprise suitable hardware, logic, circuitry, mechanical design and structure, interfaces, and/or code configured to control the supply of fuel from the fuel source to the burner 114 of the water heater 100. The fuel control valve 212 can include, but is not limited to, one or more of any of: solenoid valves, gate valves, globe valves, pinch valves, diaphragm valves, needle valves, butterfly valves, plug valves, and ball valves.

The input/output unit 214 can comprise suitable hardware, logic, circuitry, interfaces, and/or code configured to receive an input and/or transmit or display an output to a user. The input/output unit 214 can be configured to receive one or more input parameters from the user. The input/output unit 214 can comprise one or more input and output devices configured to communicate with the processor 202. Examples of the input devices can include, but are not limited to, a keyboard, a mouse, a joystick, a touch screen, a microphone, a camera, and/or a docking station. Examples of the output devices can include, but are not limited to, the display screen and/or a speaker.

In operation, the processor 202 can be configured to receive various parameters associated with the water heater 100. The various parameters can include, but are not limited to, one or more of the following: a temperature set-point corresponding to a temperature at which the water heater 100 has been set to maintain water, one or more water flow rates corresponding to the rate of flow of water in the water inlet line 102 and/or the heat exchanger 112, an inlet (or cold) water temperature corresponding to the temperature of water flowing through the water inlet line 102, an outlet (or hot) water temperature corresponding to the temperature of water flowing through the water outlet line 104, minimum and/or maximum allowed temperatures for water entering the water heater 100, an operating efficiency of the water heater 100, and a heating capacity of the water heater 100.

Using the operating parameters, the control system 122 can determine or select an operating state from among a plurality of operating states for the water heater 100. The operating states of the water heater 100 can each be a function of the inlet temperature and the delta temperature. The operating states for the water heater 100 can be defined based on science governing heat transfer applications that uses the operating parameters to identify the operating states. As an example, the operating states include a condensation state, a scaling state and a desired operating state. The scaling operating state can correspond to conditions under which scaling can form in the water heater and/or system, the condensation operation state can correspond to operating conditions under which condensation can form in the water heater and/or system, and the desired operating state can correspond to operating conditions under which the water heater and/or system is expected to function normally (e.g., without scaling and/or condensation).

The operating parameters (which can include one or more of the temperature set-point, the minimum and maximum allowed temperatures, the operating efficiency, and the heating capacity) can be set by a user using the input/output unit 214 and stored in the memory 204. The one or more of the temperature set-point, the minimum and maximum allowed temperatures, the operating efficiency, and the heating capacity can be obtained from the water heater 100 specifications, manual, or data sheets. One or more of the temperature set-point, the minimum and maximum allowed temperatures, the operating efficiency, and the heating capacity can be pre-configured (or factory set) and stored in the memory 204.

The inlet temperature sensor 206 can be configured to measure the temperature of water entering the water heater 100 via the water inlet line 102, the outlet temperature sensor 208 can be configured to measure the temperature of water exiting the water heater 100 via the water outlet line 104, and the flow rate control valve 210 can be configured to measure the water flow rate in the water inlet line 102 of the water heater 100.

The processor 202 can be configured to use one or more of the various parameters to identify an operating state of the water heater 100. The operating states of the water heater can include, but is not limited to, a scaling operating state, a condensation operating state, and a desired operating state. The processor 202 can be configured to obtain the inlet temperature ($T_{inlet}$) (i.e., the temperature of water entering the water heater 100 via the water inlet line 102) measured by the inlet temperature sensor 206. Further, the processor 202 can be configured to obtain the outlet temperature ($T_{outlet}$) (i.e. the temperature of water exiting the water heater 100 via the water outlet line 104) measured by the outlet temperature sensor 208. Further, the processor 202 can be configured to calculate a delta temperature ($\Delta T$) (i.e., the difference between the outlet temperature ($T_{outlet}$) and the inlet temperature ($T_{inlet}$)).

Alternatively, the processor can be configured to determine the delta temperature ($\Delta T$) based at least in part on the operating efficiency, heating capacity and water flow rate. For example, the processor can determine the delta temperature using the equation $$\Delta T = (\text{operating efficiency} * \text{heating capacity}) \div (500 * \text{water flow rate})$$

, where heating capacity is measured in BTUs (British Thermal Units) and water flow rate is measured in GPM (gallons per minute).

The processor 202 can be configured to compare the inlet temperature ($T_{inlet}$) and the delta temperature ($\Delta T$) to a set of rules to determine the operating state of the water heater 100. The set of rules can correlate one or more temperature ranges defined for the inlet temperature ($T_{inlet}$) and the delta temperature ($\Delta T$) to various operating states of the water heater 100, such as those expressly described herein. The processor 202 can be configured to determine the operating state of the water heater by comparing the inlet temperature ($T_{inlet}$) and the delta temperature ($\Delta T$) with their corresponding range of temperature(s) defined in the set of rules.

The set of rules may include one or more ranges of inlet temperature ($T_{inlet}$) and a threshold value for delta temperature ($\Delta T$) corresponding to each of the one or more ranges of inlet temperatures ($T_{inlet}$). The set of rules can define Lila and $\Delta T$ ranges corresponding to each of the scaling operating state, the condensation operating state, and the desired operating state. That is, the scaling operating state can correspond to a first range of inlet temperature values and a first range of delta temperature values, the condensation operating state can correspond to a second range of inlet temperature values and a second range of delta temperature values, and the desired operating state can correspond to a third range of inlet temperature values and a third range of delta temperature values. The range(s) for at least one of the inlet temperature and the delta temperature corresponding to a given operating state can overlap with the corresponding range(s) for at least one of the other operating states.

In accordance with an embodiment, the processor 202 can determine or select the set of rules based on one or more input parameters, such as the temperature set-point, the water flow rate, the minimum and maximum allowed temperatures, the operating efficiency set for the water heater 100, and/or the heating capacity of the water heater 100. The processor 202 can determine or select the set of rules for the scaling operating state, the condensation operating state, or both the scaling operating state and the condensation operating state. The rules can be determined based on relationship among the one or more input parameters, the inlet temperature ($T_{inlet}$), and the delta temperature ($\Delta T$). The set of rules can be preconfigured (factory set) and stored in the memory 204 of the water heater 100. Alternatively, the set of rules can be stored into the memory 204 and the processor 202 can be configured to execute instructions based on the set of rules.

Table 1 illustrates an example set of rules for determining the operating state of the water heater 100. A person skilled in the art will understand that Table 1 and the data therein has been provided for illustrative purposes and should not be construed to limit the scope of the disclosure.

As will be appreciated, scaling in the water heater 100 can increase with an increase in the temperature of water and/or a decrease in the water flow rate. Further, the condensation in the water heater 100 can increases with a decrease in the temperature of water and/or an increase in the water flow rate. Table 1 illustrates the relation between the inlet temperature ($T_{inlet}$) and the delta temperature ($\Delta T$) to determine the operating state of the water heater 100. The values corresponding to inlet temperature ($T_{inlet}$) and the delta temperature ($\Delta T$) can be determined based on the one or more input parameters of the water heater 100.

The inlet temperature ($T_{inlet}$) ranges and corresponding threshold values for delta temperature ($\Delta T$), as illustrated in Table 1, can be associated with a water heater 100 having a heating capacity of 400K BTU, an operating efficiency set to 85% (or 0.85), and a temperature set-point of 105 degrees Fahrenheit.

TABLE 1

| | | Inlet temperature ($T_{inlet}$ Increases→) | | | | | | | | | | | |
|---|---|---|---|---|---|---|---|---|---|---|---|---|---|
| | | 36 | 43 | 53 | 58 | 59 | 63 | 65 | 67 | 68 | 75 | 95 | 107 |
| ΔT (Increases→) | ∞ | Scaling state | | | | Scaling state | | | | | Scaling state | | |
| | 61 | | | | | | | | | | | | |
| | 60 | Desired operating state | | | | | | | | | | | |
| | 55 | | | | | | | | | | | | |
| | 52 | | | | | | | | | | | | |
| | 51 | Condensation state | | | | Desired operating state | | | | | | | |
| | 42 | | | | | | | | | | | | |
| | 35 | | | Condensation state | | | | | Desired operating state | | | | |
| | 33 | | | | | | | | | | | | |
| | 32 | | | | | | | | Condensation state | | | | |
| | 20 | | | | | | | | | | | | |
| | 0 | | | | | | | | | | | | |

As illustrated in Table 1 above, the inlet temperature ($T_{inlet}$) and delta temperature (ΔT) can defines a general boundary for various operating states of the water heater 100. For example, the inlet temperature ($T_{inlet}$) and delta temperature (ΔT), as shown in Table 1, can define three operating states: the scaling operating state, the condensation operating state, and the desired operating state of the water heater 100.

As shown in Table 1, the set of rules (the values of the inlet temperature ($T_{inlet}$) and delta temperature (ΔT)) defining the operating states of the water heater 100 can be determined by the processor 202 based on the value of the one or more input parameters. Value of the one or more input parameters may be entered by a user via the input/output module 214 or stored in the memory 204.

For example, the following, example set of rules can be derived from Table 1 to determine whether the heater is operating in the scaling operating state or the condensation operating state.

For the scaling operating state:

$$36° \text{ F.} \leq T_{inlet} < 59° \text{ F.} \& \Delta T > 61° \text{ F.});$$

$$59° \text{ F.} \leq T_{inlet} < 68° \text{ F.} \& \Delta T > 52° \text{ F.}); \text{ and}$$

$$68° \text{ F.} \leq T_{inlet} < 107° \text{ F.} \& \Delta T > 42° \text{ F.}).$$

For the condensation operating state:

$$36° \text{ F.} \leq T_{inlet} < 53° \text{ F.} \& \Delta T < 52° \text{ F.});$$

$$53° \text{ F.} \leq T_{inlet} < 63° \text{ F.} \& \Delta T < 42° \text{ F.}); \text{ and}$$

$$63° \text{ F.} \leq T_{inlet} < 107° \text{ F.} \& \Delta T < 33° \text{ F.}).$$

The above set of rules may be re-written as follows:

for the scaling operating state:

$$T1 \leq T_{inlet} < T2 \& \Delta T > \Delta T1);$$

$$T2 \leq T_{inlet} < T3 \& \Delta T > \Delta T2); \text{ and}$$

$$T3 \leq T_{inlet} < T4 \& \Delta T > \Delta T3); \text{ and}$$

for the condensation operating state:

$$T1 \leq T_{inlet} < T5 \& \Delta T < \Delta T4);$$

$$T5 \leq T_{inlet} < T6 \& \Delta T < \Delta T5); \text{ and}$$

$$T6 \leq T_{inlet} < T4 \& \Delta T < \Delta T6).$$

where T1 is the minimum inlet temperature ($T_{inlet}$) allowed and T4 is the maximum inlet temperature ($T_{inlet}$) allowed.

For a given range of the inlet temperature ($T_{inlet}$), a first threshold value of delta temperature (ΔT) and a second threshold value of delta temperature (ΔT) can be defined as the set of rules to determine an operating state of the water heater 100. For example, as illustrated in Table 1:

For $36 \leq T_{inlet} < 53$, if i.) ΔT>61° F., then water heater 100 is in the scaling operating state, ii.) ΔT<52° F., then water heater 100 is in the condensation operating state, and iii.) 52° F.≤ΔT≤61° F., then water heater 100 is in the desired operating state.

In the rule defined immediately above, 36° F.≤$T_{inlet}$<53° F. can correspond to the given range of inlet temperature ($T_{inlet}$), and the delta temperature (ΔT) values of 61° F. and 52° F. can correspond to the first threshold value of delta temperature (ΔT) and the second threshold value of delta temperature (ΔT), respectively.

Similarly, as illustrated in Table 1, for each of the other given inlet temperature ($T_{inlet}$) ranges (53° F.≤$T_{inlet}$<59° F., 59° F.≤$T_{inlet}$<63° F., 63° F.≤$T_{inlet}$<68° F., and 68° F.≤$T_{inlet}$<107° F.), the first and second threshold value of delta temperature (ΔT) can be defined, as a set of rules to determine an operating state of the water heater 100.

To summarize, for a given range of the inlet temperature ($T_{inlet}$), the set of rules can be defined as:

When $T1 \leq T_{inlet} < T2$, if:

i.) ΔT>T3, then the water heater 100 is in the scaling operating state, ii.) ΔT<T4, then the water heater 100 is in the condensation operating state, and iii.) T4≤ΔT≤T3, then the water heater 100 is in the desired operating state.

When the water heater 100 is switched on, the processor 202 can be configured to receive the inlet temperature ($T_{inlet}$) from the inlet temperature sensor 206 and the outlet temperature ($T_{outlet}$) from the outlet temperature sensor 208. The processor 202 can determine the delta temperature (ΔT) based on the difference between the inlet temperature ($T_{inlet}$) and the outlet temperature ($T_{outlet}$). Further, the processor 202 can be configured to determine an operating state of the water heater 100 by comparing the inlet temperature ($T_{inlet}$) and delta temperature (ΔT) with the corresponding temperature ranges defined in the set of rules.

When the water heater 100 is determined to be in the scaling state, the processor 202 can be configured to transmit a control signal to the flow rate control valve 210. In response, the flow rate control valve 210 can control the rate of flow of water in the water inlet line 102, such that the delta temperature (ΔT) falls below the first threshold value, driving the water heater 100 to the desired operating state. In the scaling state, the control signal can cause the flow rate control valve 210 to increase the rate of flow of water in the inlet line 102, thus, decreasing the delta temperature (ΔT) below the first threshold value.

When the water heater 100 is determined to be in the condensation operating state, the processor 202 can be configured to transmit a control signal to the flow rate control valve 210. In response, the flow rate control valve 210 can control the rate of flow of water in the water inlet line 102, such that the delta temperature (ΔT) increases above the second threshold value, driving the water heater 100 to the desired operating state. In the condensation state the control signal can cause the flow rate control valve 210 to decrease the rate of flow of water in the inlet line 102, thus, increasing the delta temperature (ΔT) above the second threshold value.

The processor 202 can be configured to determine the rate of flow of water that is required to drive the water heater 100 to the desired operating state from the scaling state or the condensation state. During the scaling state or the condensations state, the processor 202 can determine the rate of flow of water based on a predefined relationship between the water temperature and rate of flow of water.

When the water heater 100 is determined to be in the scaling state or the condensation state, the processor 202 can be configured to perform one or more of turning off the water heater 100, sending a control signal to the input/output unit 214 to display a notification on a display associated with the water heater 100, sending a notification to an electronic device using a wireless or a wired communication protocol, and/or activating an alarm of the water heater 100.

The processor 202 can be configured to determine the water flow rate required to maintain the water heater 100 in the desired operating state. The processor 202 can determine the required water flow rate using the inlet temperature ($T_{inlet}$) and the delta temperature (ΔT).

Figure 3:
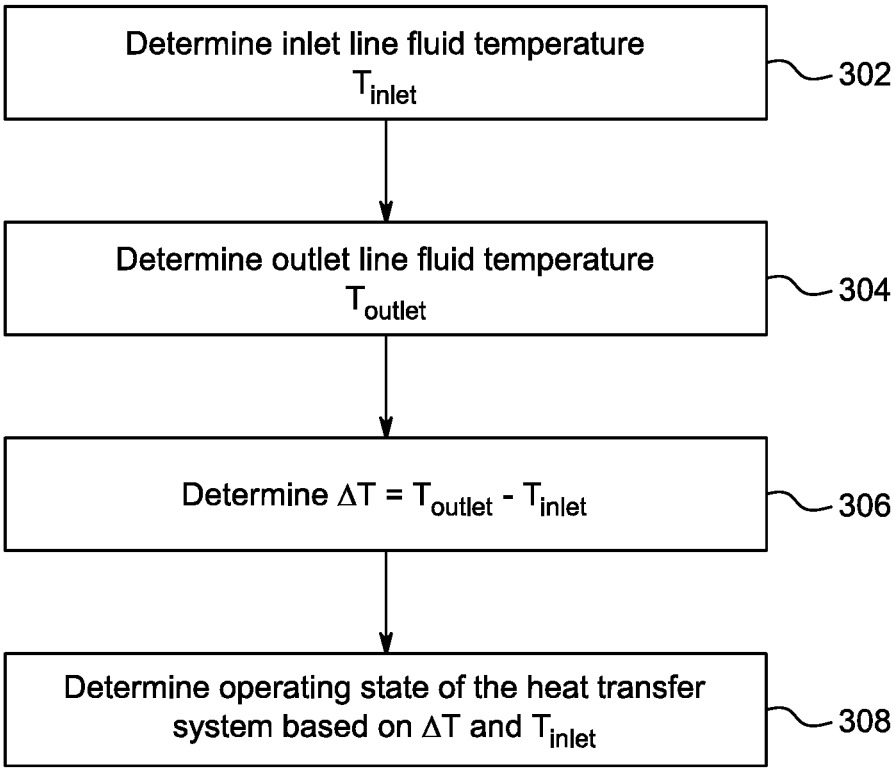
FIG. 3 is a flowchart that illustrates an example method of controlling the heat transfer system, in accordance with the disclosure.

FIG. 3 is an exemplary flow chart that illustrates a method implemented in a heat transfer system to determine an operating state of the heat transfer system, in accordance with the present disclosure. FIG. 3 is described in conjunction with elements of FIG. 1 and FIG. 2. With reference to FIG. 3, there is shown an exemplary flow chart 300 that illustrates a method implemented in the water heater 100 to determine the operating state of the water heater 100. The method begins at step 302.

At step 302, inlet line fluid temperature ($T_{inlet}$) can be determined. The inlet line fluid temperature ($T_{inlet}$) can correspond to the temperature of water flowing in the water inlet line 102 of the water heater 100. The inlet line fluid temperature ($T_{inlet}$) can be determined using the inlet temperature sensor 206.

At step 304, outlet line fluid temperature ($T_{outlet}$) can be determined. The outlet line fluid temperature ($T_{outlet}$) can correspond to the temperature of water flowing in the water outlet line 104 of the water heater 100. The outlet line fluid temperature ($T_{outlet}$) can be determined using the outlet temperature sensor 208.

At step 306, delta temperature (ΔT) can be determined. The delta temperature (ΔT) can be determined by calculating a difference between the outlet line fluid temperature ($T_{outlet}$) and the inlet line fluid temperature ($T_{inlet}$).

At step 308, the operating state of the heat transfer system, such as the water heater 100, can be determined. The operating state of the water heater 100 can be determined based on the inlet line fluid temperature ($T_{inlet}$) and the delta temperature (ΔT). The set of rules as described above in conjunction with Table 1 can be used to determine the operating state corresponding to the determined inlet line fluid temperature ($T_{inlet}$) and the delta temperature (ΔT).

Figure 4:
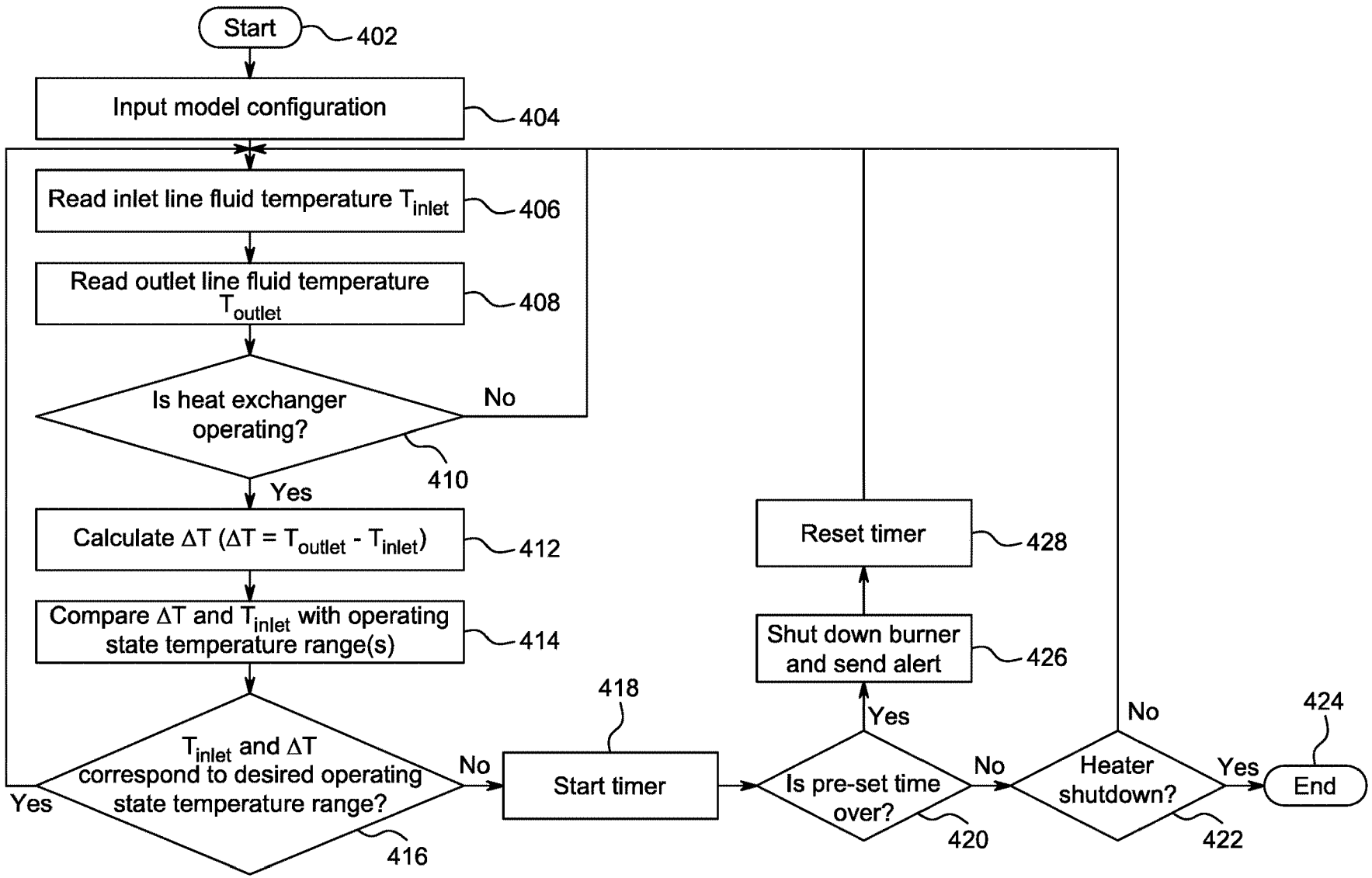
FIG. 4 is a flowchart that illustrates another example method of controlling the heat transfer system, in accordance with the disclosure.

FIG. 4 is another exemplary flow chart that illustrates another method implemented in a heat transfer system, in accordance with the present disclosure. FIG. 4 is described in conjunction with elements of FIG. 1 and FIG. 2. With reference to FIG. 4, there is shown an exemplary flow chart 400 that illustrates a method implemented in the water heater 100 to control the operating state of the water heater 100. The method begins at step 402 and proceeds to step 404.

At step 404, a model configuration can be input into the memory 204. The model configuration can include various parameters associated with the water heater 100. One or more of the various parameters, such as the temperature set-point, the minimum and maximum allowed temperatures, the operating efficiency, and/or the heating capacity of the water heater 100 can be input by the user. One or more of these various parameters may be preconfigured or stored in the memory 204 and the processor 202 can receive the values of various parameters from the memory 204.

At step 406, inlet temperature ($T_{inlet}$) measured by the inlet temperature sensor (206) can be read by the processor 202. At step 408, outlet temperature ($T_{outlet}$) measured by the outlet temperature sensor (208) can be read by the processor 202.

At step 410, it can be determined whether the heat exchanger 112 is operating. In instances when the heat exchanger 112 is not operating, the control passes to step 406. In instances when the heat exchanger 112 is operating, the control passes to step 412. At step 412, delta temperature (ΔT) can be calculated based on the difference between the inlet temperature ($T_{inlet}$) and the outlet temperature ($T_{outlet}$).

At step 414, the delta temperature (ΔT) and the inlet temperature ($T_{inlet}$) can be compared with the set of rules comprising the ΔT and $T_{inlet}$ temperature ranges defined for various operating states of the water heater 100.

At step 416, it can be determined whether the ΔT and the $T_{inlet}$ correspond to the desired operating state of the water heater 100. In instances when the ΔT and the $T_{inlet}$ correspond to the desired operating state, the control passes to step 406. In instances when the ΔT and the $T_{inlet}$ do not correspond to the desired operating state, the control passes to step 418.

At step 418, a timer can be started. At step 420, it can be determined whether a preset or predetermined time has expired. In instances when the preset time has expired, the control passes to step 426. At step 426, the burner 114 of the water heater 100 can be shut down and an alert may be sent. The alert can be sent to an electronic device using a wireless or a wired communication protocol, and/or displayed on the input/output unit 214. Sending an alert can include activating an alarm associated with the water heater 100. The processor 202 can send a control signal to the fuel control valve 212 to stop supply of the fuel to the burner 114, thus shutting down the burner 114. At step 428, the timer can be reset, and the control passes to step 406.

In instances when the preset time (step 420) has not expired, the control passes to step 422. At step 422, it can be determined whether the water heater 100 has been shut down. In instances when the water heater 100 has not been shut down, the control passes to step 406. In instances when the water heater 100 has been shut down, the control passes to end step 424. In the duration of the preset time, the processor 202 can be configured to drive the water heater 100 to the desired operating state.

When the operating state is determined to be the scaling operating state or the condensation operating state, the processor 202 can be configured to drive the water heater 100 from the scaling sate or the condensation state to the desired operating state. To drive the water heater 100 to the desired operating state, the processor 202 can be configured to perform calculations to determine a measure of the water flow rate required to increase or decrease the delta temperature (ΔT). The processor 202 can use the set of rules to determine a value below or above which the delta temperature (ΔT) may be maintained to drive the water heater 100 to the desired operating state. For example, as shown in Table 1, when the inlet temperature ($T_{inlet}$) is in the range 36° F.≤$T_{inlet}$<43° F., delta temperature (ΔT) should be less than or equal to 61° F. and greater than or equal to 52° F. for the water heater 100 to be in the desired operating state.

When the water heater 100 is determined to be in the scaling state, the processor 202 can determine a first value of water flow rate required to decrease the delta temperature (ΔT) to a value that drives the water heater 100 to the desired operating state. The processor 202 can transmit a signal to the flow rate control valve 212 to increase the water flow rate in the water inlet line 102 to the first value, thus driving the water heater 100 to the desired operating state from the scaling state.

When the water heater 100 is determined to be in the condensation state, the processor 202 can determine a second value of water flow rate required to increase the delta temperature (ΔT) to a value that drives the water heater 100 to the desired operating state. The processor 202 can transmit a signal to the flow rate control valve 212 to decrease the water flow rate in the water inlet line 102 to the second value, thus driving the water heater 100 to the desired operating state from the condensation state.

Although the heat transfer system as discussed in the present disclosure is explained with reference to a water heater, the heat transfer system discussed in the present disclosure can find application in various heating and cooling applications, such as hydronic heating and cooling systems, swimming pool and spa water heating systems, and the like.

The present disclosure can be realized in hardware, or a combination of hardware and software. The present disclosure can be realized in a centralized fashion, in at least one computer system, or in a distributed fashion, where different elements can be spread across several interconnected computer systems. A computer system or other apparatus adapted to carry out the methods described herein can be suited. A combination of hardware and software can be a general-purpose computer system with a computer program that, when loaded and executed, can control the computer system such that it carries out the methods described herein. The present disclosure can be realized in hardware that comprises a portion of an integrated circuit that also performs other functions.

The present disclosure can also be embedded in a computer program product, which comprises all the features that enable the implementation of the methods described herein, and which when loaded in a computer system is able to carry out these methods. Computer program as used herein, includes any expression, in any language, code or notation, of a set of instructions intended to cause a system that have information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made, and equivalents may be substituted without deviation from the scope of the present disclosure. In addition, many modifications may be made to adapt a particular situation or material to the teachings of the present disclosure without deviation from its scope. Therefore, it is intended that the present disclosure not be limited to the particular embodiment disclosed, but that the present disclosure will include all embodiments that fall within the scope of the appended claims.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented by use of a wide variety of suitable processes and system modules, and are not limited to any particular computer hardware, software, middleware, firmware, microcode, and the like. The claims can encompass embodiments for hardware and software, or a combination thereof

What is claimed is:

1. A heat transfer system comprising:

a fluid inlet line;

a first temperature sensor configured to detect a temperature of fluid within the fluid inlet line;

a fluid outlet line;

a second temperature sensor configured to detect a temperature of fluid within the fluid outlet line;

a heat exchanger operatively disposed between the fluid inlet line and the fluid outlet line; and a processor configured to:

obtain an inlet temperature from the first temperature sensor;

obtain an outlet temperature from the second temperature sensor;

determine a delta temperature based on difference between the inlet temperature and the outlet temperature;

determine a current operating state of the heat transfer system based on the inlet temperature and the delta temperature, the current operating state being a scaling operating state or a condensation operating state; and output operating instructions to cause the heat transfer system to transition from the current operating state to a target operating state, wherein when the delta temperature is greater than or equal to a first threshold value, the heat transfer system is in the scaling operating state, wherein when the delta temperature is less than or equal to a second threshold value that is less than the first threshold value, the heat transfer system is the condensation operating state, and wherein when the delta temperature is between the first threshold value and the second threshold value, the heat transfer system is in the target operating state.

2. The heat transfer system of claim 1, wherein the operating instructions comprise:

instructions for adjusting a flow of fluid through the heat transfer system; and/or adjusting a heat output of the heat exchanger.

3. The heat transfer system of claim 1, wherein if the current operating state is the scaling operating state, the operating instructions comprise instructions for adjusting a fluid flow into the heat exchanger such that the delta temperature decreases to become less than or equal to the first threshold value.

4. The heat transfer system of claim 1, wherein if the current operating state is the condensation operating state, the operating instructions comprise instructions for adjusting a fluid flow into the heat exchanger such that the delta temperature increases to become greater than or equal to the second threshold value.

5. The heat transfer system of claim 1, wherein if the current operating state is the scaling operating state or the condensation operating state, the operating instructions comprise instructions for at least one of: turning off the heat transfer system, displaying a notification on a display associated with the heat transfer system, sending a notification to an electronic device, and activating an alarm of the heat transfer system.

6. The heat transfer system of claim 1, wherein the processor is further configured to determine, based at least in part on the inlet temperature and the delta temperature, a fluid-flow rate into the heat exchanger to maintain the heat transfer system in the target operating state.

7. A method of controlling a heat transfer system comprising:

obtaining, by a processor, operating parameters for a heat exchanger;

processing, by the processor, the operating parameters to determine a plurality of operating states for the heat exchanger, the plurality of operating states comprising a target operating state and at least one of a scaling operating state and a condensation operating state;

obtaining, by the processor, an inlet temperature corresponding to a fluid inlet line;

obtaining, by the processor, an outlet temperature corresponding to a fluid outlet line;

determining, by the processor, a delta temperature based on a difference between the inlet temperature and the outlet temperature;

determining, by the processor and based at least in part on the inlet temperature and the delta temperature, a current operating state of the heat exchanger, the current operating state being one of the plurality of operating states;

determining, by the processor, a fluid-flow rate into the heat exchanger to maintain the heat exchanger in the target operating state; and if the current operating state is not the target operating state, outputting operating instructions to cause the heat exchanger to transition to the target operating state, wherein when the delta temperature is greater than or equal to a first threshold value, the heat exchanger is in the scaling operating state, wherein when the delta temperature is less than or equal to a second threshold value, the heat exchanger is in the condensation operating state, and wherein when the delta temperature is between the first threshold value and the second threshold value, the heat exchanger is in the target operating state.

8. The method of claim 7, wherein if the current operating state is the scaling operating state, the operating instructions comprise instructions for adjusting a fluid flow into the heat exchanger such that the delta temperature decreases to become less than or equal to the first threshold value.

9. The method of claim 7, wherein if the current operating state is the condensation operating state, the operating instructions comprise instructions for adjusting a fluid flow into the heat exchanger such that the delta temperature increases to become greater than or equal to the second threshold value.

10. The method of claim 7, wherein if the current operating state is the scaling state or the condensation state, the operating instructions comprise instructions for at least one of: turning off the heat transfer system, displaying a notification on a display associated with the heat transfer system, sending a notification to an electronic device, and activating an alarm of the heat transfer system.

11. A non-transitory computer-readable medium having instructions stored thereon that, when executed by a processor, cause the processor to perform operations comprising:

obtaining an inlet temperature corresponding to a fluid inlet line;

obtaining an outlet temperature corresponding to a fluid outlet line;

determining a delta temperature based on difference between the inlet temperature and the outlet temperature;

determining, based at least in part on the inlet temperature and the delta temperature, a current operating state of a heat exchanger, the current operating state being one of a plurality of operating states comprising a target operating state and at least one of a scaling operating state and a condensation operating state;

if the current operating state is not the target operating state, outputting operating instructions to cause the heat exchanger to transition to the target operating state;

obtaining operating parameters for the heat exchanger; and processing the operating parameters to determine the plurality of operating states;

wherein when the delta temperature is greater than or equal to a first threshold value, the heat exchanger is in the scaling operating state, wherein when the delta temperature is less than or equal to a second threshold value, the heat exchanger is in the condensation operating state, and wherein when the delta temperature is between the first threshold value and the second threshold value, the heat exchanger is in the target operating state.

12. The non-transitory computer-readable medium according to claim 11, wherein if the current operating state is the scaling operating state, the operating instructions comprise instructions for adjusting a fluid flow into the heat exchanger such that the delta temperature decreases to become less than or equal to the first threshold value.

13. The non-transitory computer-readable medium according to claim 11, wherein if the current operating state is the condensation operating state, the operating instructions comprise instructions for adjusting a fluid flow into the heat exchanger such that the delta temperature increases to become greater than or equal to the second threshold value.

14. The non-transitory computer-readable medium according to claim 11, wherein if the current operating state is the scaling state or the condensation state, operating instructions comprise instructions for at least one of: turning off the heat transfer system, displaying a notification on a display associated with the heat transfer system, sending a notification to an electronic device, and activating an alarm of the heat transfer system.

15. The non-transitory computer-readable medium according to claim 11, wherein the instructions, when executed by the processor, further cause the processor to perform operations comprising:

determining, based at least in part on the inlet temperature and the delta temperature, a fluid-flow rate into the heat exchanger to maintain the heat exchanger in the desired operating state.

* * * * *